US009058812B2

(12) United States Patent
Ashley et al.

(10) Patent No.: US 9,058,812 B2
(45) Date of Patent: Jun. 16, 2015

(54) METHOD AND SYSTEM FOR CODING AN INFORMATION SIGNAL USING PITCH DELAY CONTOUR ADJUSTMENT

(75) Inventors: James P. Ashley, Naperville, IL (US); Udar Mittal, Hoffman Estates, IL (US)

(73) Assignee: GOOGLE TECHNOLOGY HOLDINGS LLC, Mountain View, CA (US)

( * ) Notice: Subject to any disclaimer, the term of this patent is extended or adjusted under 35 U.S.C. 154(b) by 1939 days.

(21) Appl. No.: 11/190,680

(22) Filed: Jul. 27, 2005

(65) Prior Publication Data

US 2007/0027680 A1 Feb. 1, 2007

(51) Int. Cl.

*G10L 21/06* (2013.01)
*G10L 21/00* (2013.01)
*G10L 19/09* (2013.01)

(52) U.S. Cl.

CPC ..... *G10L 19/09* (2013.01); *G10L 21/00* (2013.01); *G10L 21/06* (2013.01)

(58) Field of Classification Search

USPC ..... 704/205–225, 258, 267, 200–201, 704/229–230, 500–504, E19–E19.049; 370/260, 342, 465; 375/259; 455/403, 455/423

See application file for complete search history.

(56) References Cited

U.S. PATENT DOCUMENTS 4,201,958 A * 5/1980 Ahamed ..... 341/143
4,821,324 A * 4/1989 Ozawa et al. ..... 704/216
4,890,325 A * 12/1989 Taniguchi et al. ..... 704/208
5,097,508 A 3/1992 Valenzuela Steude et al.
5,253,269 A 10/1993 Gerson et al.
5,359,696 A 10/1994 Gerson et al.
5,495,555 A * 2/1996 Swaminathan ..... 704/207
5,553,191 A * 9/1996 Minde ..... 704/219
5,699,478 A * 12/1997 Nahumi ..... 704/226
5,699,485 A * 12/1997 Shoham ..... 704/223
5,704,003 A * 12/1997 Kleijn et al. ..... 704/220
5,774,837 A * 6/1998 Yeldener et al. ..... 704/208
5,778,334 A * 7/1998 Ozawa et al. ..... 704/219
5,809,459 A * 9/1998 Bergstrom et al. ..... 704/223
5,819,213 A * 10/1998 Oshikiri et al. ..... 704/222
5,924,063 A * 7/1999 Funaki et al. ..... 704/223
6,009,395 A * 12/1999 Lai et al. ..... 704/264
6,113,653 A * 9/2000 Ashley et al. ..... 704/219
6,199,035 B1 * 3/2001 Lakaniemi et al. ..... 704/207
6,212,496 B1 * 4/2001 Campbell et al. ..... 704/221
6,345,248 B1 * 2/2002 Su et al. ..... 704/223

(Continued)

FOREIGN PATENT DOCUMENTS

EP 833305 A2 * 4/1998 ..... G10L 9/14
EP 1093116 A1 * 1/2001 ..... G10L 19/12

OTHER PUBLICATIONS

Gerson et al., "Techniques for Improving the Performance of CELP-type Speech Coders", IEEE Journal on Selected Areas in Communications, Jun. 1992, 858-865 vol. 10 Issue 5.*

(Continued)

*Primary Examiner* — Pierre-Louis Desir
*Assistant Examiner* — David Kovacek
(74) *Attorney, Agent, or Firm* — Birch, Stewart, Kolasch & Birch, LLP

(57) ABSTRACT

In a speech encoder/decoder a pitch delay contour endpoint modifier is employed to shift the endpoints of a pitch delay interpolation curve up or down. Particularly, the endpoints of the pitch delay interpolation curve are shifted based on a variation and/or a standard deviation in pitch delay.

21 Claims, 5 Drawing Sheets

(56) References Cited

U.S. PATENT DOCUMENTS

| | | | | |
|---|---|---|---|---|
| 6,470,312 | B1 * | 10/2002 | Suzuki et al. | 704/219 |
| 6,507,814 | B1 * | 1/2003 | Gao | 704/220 |
| 6,581,031 | B1 * | 6/2003 | Ito et al. | 704/222 |
| 6,584,438 | B1 * | 6/2003 | Manjunath et al. | 704/228 |
| 6,604,070 | B1 * | 8/2003 | Gao et al. | 704/222 |
| 6,636,829 | B1 * | 10/2003 | Benyassine et al. | 704/201 |
| 6,760,698 | B2 * | 7/2004 | Gao | 704/207 |
| 6,782,360 | B1 * | 8/2004 | Gao et al. | 704/222 |
| 6,804,203 | B1 * | 10/2004 | Benyassine et al. | 370/286 |
| 7,072,832 | B1 * | 7/2006 | Su et al. | 704/230 |
| 2002/0016161 | A1 * | 2/2002 | Dellien et al. | 455/403 |
| 2002/0116182 | A1 * | 8/2002 | Gao et al. | 704/205 |
| 2002/0147583 | A1 * | 10/2002 | Gao | 704/223 |
| 2004/0002855 | A1 * | 1/2004 | Jabri et al. | 704/219 |
| 2004/0002856 | A1 * | 1/2004 | Bhaskar et al. | 704/219 |
| 2004/0024594 | A1 * | 2/2004 | Lee et al. | 704/219 |
| 2004/0102966 | A1 * | 5/2004 | Sung et al. | 704/219 |
| 2004/0109471 | A1 * | 6/2004 | Minde et al. | 370/465 |
| 2005/0053130 | A1 * | 3/2005 | Jabri et al. | 375/240 |
| 2005/0091044 | A1 * | 4/2005 | Ramo et al. | 704/207 |
| 2005/0137863 | A1 * | 6/2005 | Jasiuk et al. | 704/222 |
| 2005/0137864 | A1 * | 6/2005 | Valve et al. | 704/227 |
| 2007/0027680 | A1 * | 2/2007 | Ashley et al. | 704/207 |

OTHER PUBLICATIONS

Deyuan, Cheng; "An 8 kb/s Low Complexity ACELP Speech Codec", 3rd International Conference on Signal processing, Oct. 14-18, 1996, 671-674 vol. 1.*

* cited by examiner

400

METHOD AND SYSTEM FOR CODING AN INFORMATION SIGNAL USING PITCH DELAY CONTOUR ADJUSTMENT

FIELD OF THE INVENTION

The present invention relates, in general, to communication systems and, more particularly, to coding information signals in such communication systems.

BACKGROUND OF THE INVENTION

Digital speech compression systems typically require estimation of the fundamental frequency of an input signal. The fundamental frequency $f_0$ is usually estimated in terms of the pitch delay $\tau_0$ (otherwise known as "lag"). The two are related by the expression $$\tau_0 = \frac{f_s}{f_0'} \tag{1}$$

where the sampling frequency $f_s$, is commonly 8000 Hz for telephone grade applications.

Since a speech signal is generally non-stationary, it is partitioned into finite length vectors called frames, each of which is presumed to be quasi-stationary. The length of such frames is normally on the order of 10 to 40 milliseconds. The parameters describing the speech signal are then updated at the associated frame length intervals. The original Code Excited Linear Prediction (CELP) algorithms further updates the pitch period (using what is called Long Term Prediction, or LTP) information on shorter sub-frame intervals, thus allowing smoother transitions from frame to frame. It was also noted that although $\tau_0$ could be estimated using open-loop methods, far better performance was achieved using the closed-loop approach. Closed-loop methods involve a trial-and-error search of different possible values of $\tau_0$ (typically integer values from 20 to 147) on a sub-frame basis, and choosing the value that satisfies some minimum error criterion.

An enhancement to this method involves allowing $\tau_0$ to take on integer plus fractional values, as given in U.S. Pat. No. 5,359,696. An example of a practical implementation of this method can be found in the GSM half rate speech coder, and is shown in FIG. 1 and described in U.S. Pat. No. 5,253,269. Here, lags within the range of 21 to 22⅔ are allowed ⅓ sample resolution, lags within the range of 23 to 34⅚ are allowed ⅙ sample resolution, and so on. In order to keep the search complexity low, a combination of open-loop and closed loop methods is used. The open-loop method involves generating an integer lag candidate list using an autocorrelation peak picking algorithm. The closed-loop method then searches the allowable lags in the neighborhood of the integer lag candidates for the optimal fractional lag value. Furthermore, the lags for sub-frames 2, 3, and 4 are coded based on the difference from the previous sub-frame. This allows the lag information to be coded using fewer bits since there is a high intra-frame correlation of the lag parameter. Even so, the GSM HR codec uses a total of 8+(3×4)=20 bits every 20 ms (1.0 kbps) to convey the pitch period information.

In an effort to reduce the bit rate of the pitch period information, an interpolation strategy was developed that allows the pitch information to be coded only once per frame (using only 7 bits=>350 bps), rather than with the usual sub-frame resolution. This technique is known as relaxed CELP (or RCELP), and is the basis for the Enhanced Variable Rate Codec (EVRC) standard for Code Division Multiple Access (CDMA) wireless telephone systems. The basic principle is as follows.

The pitch period is estimated for the analysis window centered at the end of the current frame. The lag (pitch delay) contour is then generated, which consists of a linear interpolation of the past frame's lag to the current frame's lag. The linear prediction (LP) residual signal is then modified by means of sophisticated polyphase filtering and shifting techniques, which is designed to match the residual waveform to the estimated pitch delay contour. The primary reason for this residual modification process is to account for accuracy limitations of the open-loop integer lag estimation process. For example, if the integer lag is estimated to be 32 samples, when in fact the true lag is 32.5 samples, the residual waveform can be in conflict with the estimated lag by as many as 2.5 samples in a single 160 sample frame. This can severely degrade the performance of the LTP. The RCELP algorithm accounts for this by shifting the residual waveform during perceptually insignificant instances in the residual waveform (i.e., low energy) to match the estimated pitch delay contour. By modifying the residual waveform to match the estimated pitch delay contour, the effectiveness of the LTP is preserved, and the coding gain is maintained. In addition, the associated perceptual degradations due to the residual modification are claimed to be insignificant.

A further improvement to processing of the pitch delay contour information has been proposed in U.S. Pat. No. 6,113,653, in which a method of adjusting the pitch delay contour at intervals of less than of equal to one block in length is disclosed. In this method, a small number of bits are used to code an adjustment of the pitch delay contour according to some error minimization criteria. The method describes techniques for pitch delay contour adjustment by minimization of an accumulated shift parameter, or maximization of the cross correlation between the perceptually weighted input speech and the adaptive codebook (ACB) contribution passed through a perceptually weighted synthesis filter. Another well known pitch delay adjustment criterion may also include the minimization of the perceptually weighted error energy between the target speech and the filtered ACB contribution.

While this method utilizes a very efficient technique for estimating and coding pitch delay contour adjustment information, the low bit rate has the consequence of constraining the resolution and/or dynamic range of the pitch delay adjustment parameters being coded. Therefore a need exists for improving performance of low bit rate long-term predictors by adaptively modifying the dynamic range and resolution of the predictor step-size, such that higher long-term prediction gain is achieved for a given bit-rate, or alternatively, a similar long-term prediction is achieved at a lower bit-rate when compared to the prior art.

DETAILED DESCRIPTION OF THE PREFERRED EMBODIMENT

Figure 1:
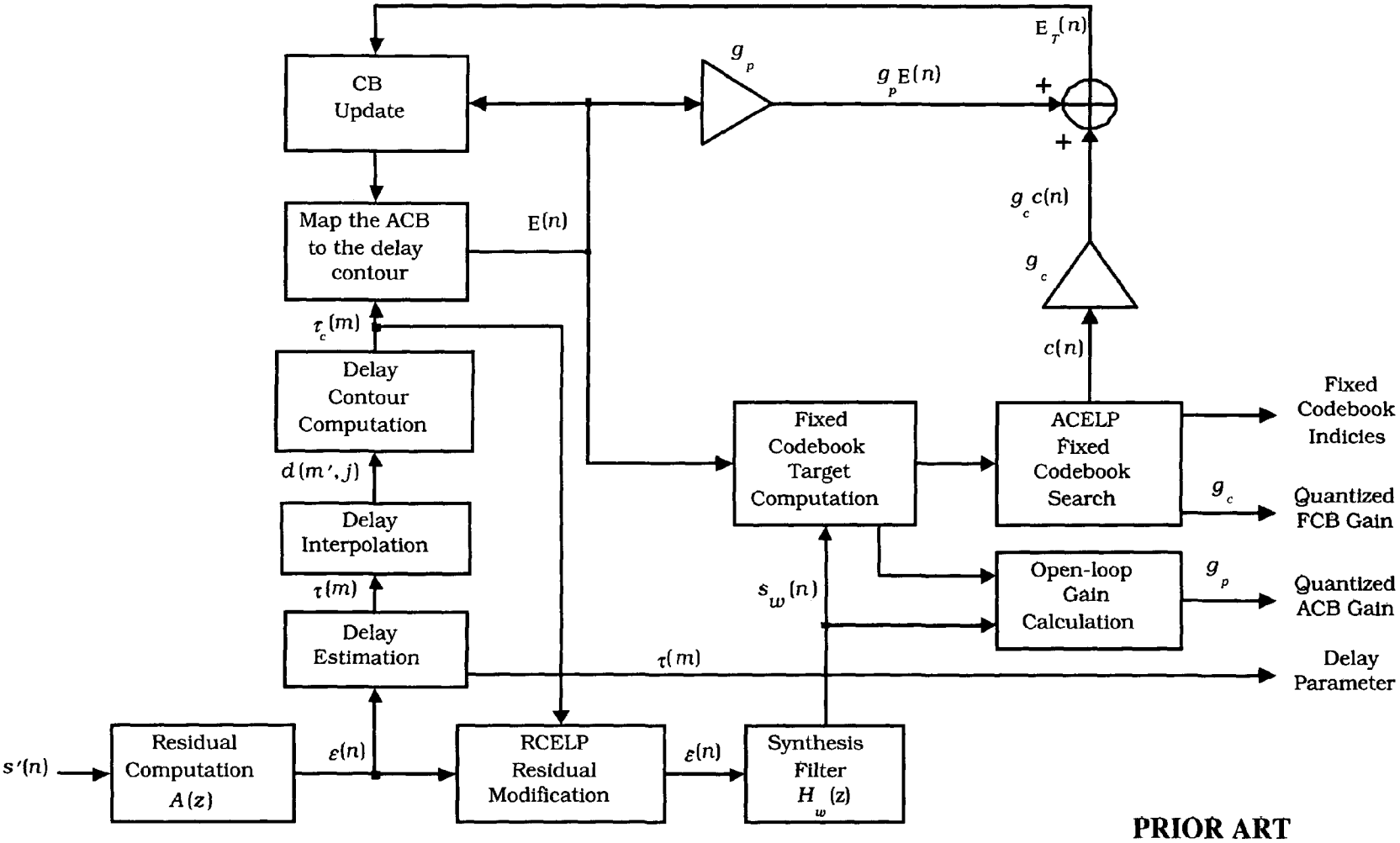
PRIOR ART FIG. 1
FIG. 1 is a block diagram of a prior-art speech encoder.

Stated generally, an open-loop pitch delay contour estimator generates pitch delay information during coding of an information signal. The pitch delay contour (i.e., a linear interpolation of the past frame's lag to the current frame's lag) is adjusted on a sub-frame basis which allows a more precise estimate of the true pitch delay contour. A pitch delay contour reconstruction block uses the pitch delay information in a decoder in reconstructing the information signal between frames. In the preferred embodiment of the present invention adjustment of the pitch delay contour is based on a standard deviation and/or a variance in pitch delay ($\tau_0$).

Stated more specifically, a method for coding an information signal comprises the steps of dividing the information signal into blocks, estimating the pitch delay of the current and previous blocks of information and forming an adjustment in pitch delay based on a past changes (e.g., standard deviation and/or variance) in $\tau_0$. The method further includes the steps of adjusting the shape of the pitch delay contour at intervals of less than or equal to one block in length and coding the shape of the adjusted pitch delay contour to produce codes suitable for transmission to a destination.

The step of adjusting the shape of the pitch delay contour at intervals of less than or equal to one block in length further comprises the steps of determining the adjusted pitch delay at a point at or between the current and previous pitch delays and forming a linear interpolation between the previous pitch delay point and the adjusted pitch delay point. When determining the adjusted pitch delay point, a change in accumulated shift is minimized. The step of determining the adjusted pitch delay further comprises the step of maximizing the correlation between a target residual signal and the original residual signal. The previous pitch delay point further comprises a previously adjusted pitch delay point. Alternatively, the step of adjusting the shape of the pitch delay contour further comprises the steps of determining a plurality of adjusted pitch delay points at or between the current and previous pitch delays and forming a linear interpolation between the adjusted pitch delay points.

A system for coding an information signal is also disclosed. The system includes an coder which comprises means for dividing the information signal into blocks and means for estimating the pitch delay of the current and previous blocks of information and for adjusting a pitch delay based on a past changes (e.g., standard deviation and/or variance) in $\tau_0$.

Within the system, the information signal further comprises either a speech or an audio signal and the blocks of information signals further comprise frames of information signals. The pitch delay information further comprises a pitch delay adjustment index. The system also includes a decoder for receiving the pitch delay information and for producing an adjusted pitch delay contour $\tau_c(n)$ for use in reconstructing the information signal.

Figure 2:
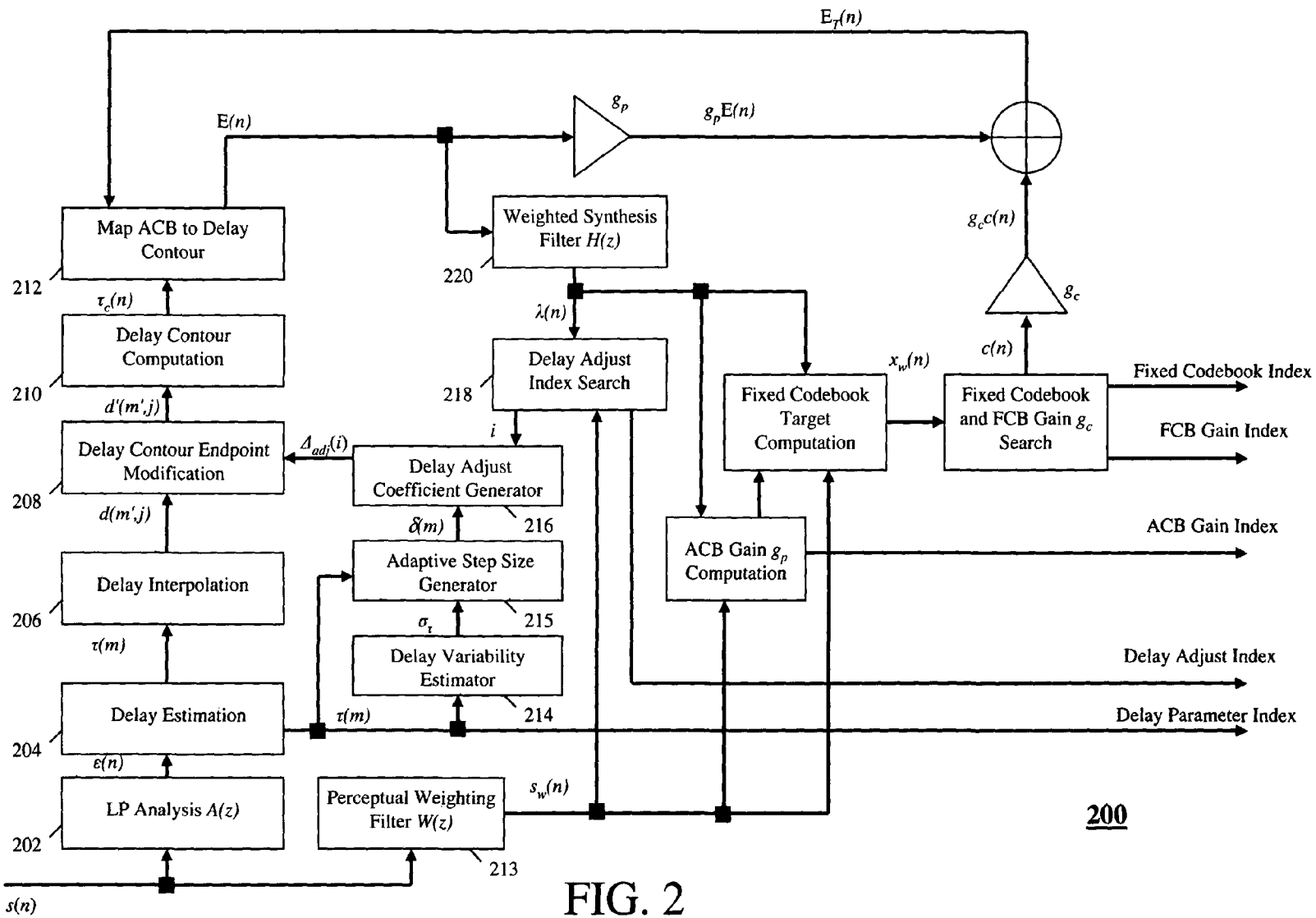
FIG. 2 is a block diagram of a speech encoder.

FIG. 2 generally depicts a speech compression system 200 employing adaptive step-size pitch delay adjustment in accordance with the preferred embodiment of the present invention. As shown in FIG. 2, the input speech signal s(n) is processed by a linear prediction (LP) analysis filter 202 which flattens the short-term spectral envelope of input speech signal s(n). The output of the LP analysis filter is designated as the LP residual $\epsilon(n)$. The LP residual signal $\epsilon(n)$ is then used by the open-loop pitch delay estimator 204 to generate the open-loop pitch delay $\tau(m)$. (Details of this and some other processes in the following discussion are given in TIA-127 EVRC.) The open-loop pitch delay $\tau(m)$ is then used by pitch delay interpolation block 206 to produce a subframe delay interpolation endpoint matrix d(m',j) according to the expression:

$$d(m', j) = \begin{cases} \tau(m), & |\tau(m) - \tau(m-1)| > 15 \\ (1 - f(j))\tau(m-1) + f(j)\tau(m), & \text{otherwise} \end{cases}, \quad 1 \le m' < 3 \tag{2}$$

where $\tau(m)$ is the estimated open-loop pitch delay for the current frame m, which is centered at the end current frame, $\tau(m-1)$ is the estimated open-loop pitch delay for the previous frame m−1, and $f(n)$ is a set of pitch delay interpolation coefficients, which may be defined as:

$$f=\{0.0, 0.3313, 0.6625, 1.0\} \tag{3}$$

These coefficients are given for the example of when the number of sub-frames is three (e.g, 0<m'<3), although a suitable set of coefficients can be derived for a value of sub-frames other than three.

Also using the open-loop pitch delay $\tau(m)$ as input is the pitch delay variability estimator 214. In accordance with the current invention, the sample standard deviation of the open-loop pitch delay estimate is defined as:

$$\sigma_\tau = \sqrt{\frac{1}{N-1}\sum_{i=0}^{N-1}(\tau(m-i) - \bar{\tau})^2} \tag{4}$$

where the sample mean $\bar{\tau}$ is defined as:

$$\bar{\tau} = \frac{1}{N}\sum_{i=0}^{N-1}\tau(m-i) \tag{5}$$

When the number of observations is two (N=2), it can be shown that the above expressions can be simplified to the following:

$$\sigma_\tau = \frac{1}{\sqrt{2}}|\tau(m) - \tau(m-1)| \tag{6}$$

The variability estimate $\sigma_\tau$, and the open-loop pitch delay $\tau(m)$ are then used as inputs to the adaptive step size generator 215, where the adaptive step size $\delta(m)$ is calculated as a function of $\sigma_\tau$, as:

$$\delta(m) = \alpha(\sigma_\tau)\left(\frac{\tau(m) + \tau(m-1)}{2}\right), \tag{7}$$

where $\alpha(\sigma_\tau)$ is some function of the variability estimate of pitch delay. For the preferred embodiment of the present invention, this function is given as:

$$\alpha(\sigma_\tau)=\min(\text{Å}\sigma_\tau+B, \alpha_{max}) \tag{8}$$

where A and B may be constants, $\sigma_\tau$, represents the standard deviation in $\tau$, and $\alpha_{max}$ may be some maximum allowable value of $\alpha(\sigma_\tau)$. The adaptive step-size $\delta(m)$ is input to the delay adjust coefficient generator 216, where the pitch delay adjust value $\Delta_{adj}(i)$ may be calculated as a function of the pitch delay adjust index i as:

$$\Delta_{adj}(i)=(i-M/2)\cdot\delta(m), i\epsilon\{0,1,\ldots,M-1\} \tag{9}$$

where M is the number of candidate pitch delay adjustment indices. From the equations above, it can be seen that the pitch delay adjust value $\Delta_{adj}(i)$ may take on integral multiples of the step-size $\delta(m)$, where $\delta(m)$ is a function of not only the average (mean) value of the pitch delay (as in the prior at), but also the variability estimate $\sigma_\tau$ of the pitch delay value $\tau(m)$. The various pitch delay adjust values may then be evaluated according to some distortion metric, and as a result, the optimal value of the pitch delay adjust value may be used throughout the remainder of the coding process. In the preferred embodiment, the distortion metric is the perceptually weighted mean squared error between the i-th filtered adaptive codebook contribution $\lambda(i,n)$, and the weighted target signal $s_w(n)$. This process is given in pitch delay adjust index search 218 and can be expressed as:

$$i^* = \underset{i\in 0,1,\ldots,M-1}{\operatorname{argmax}}\left[\frac{\left(\sum_{n=0}^{L-1} s_w(n)\lambda(i,n)\right)^2}{\sum_{n=0}^{L-1}\lambda^2(i,n)}\right] \tag{10}$$

where i* is the optimal pitch delay adjust index corresponding to the maximum value obtained from the bracketed expression.

In order to obtain the signals used in Eq. 10, the pitch delay contour endpoint modifier 208 is employed to shift the endpoints of the pitch delay interpolation curve up or down according to the expression:

$$d'(m',j)=d(m',j)+\Delta_{adj}(i) \tag{11}$$

From this expression, a candidate pitch delay contour $\tau_c(n)$ is computed 210, and an adaptive codebook contribution E(n) is obtained 212 and filtered 220 to obtain the filtered adaptive codebook contribution $\lambda(n)$ as in the prior art.

During operation standard variables such as the fixed codebook indices, the FCB and ACB gain index, etc. are transmitted by transmitter 200. Along with these values, a delay adjust index (i) for each subframe is transmitted along with a code for the pitch delay value for the current frame $\tau(m)$. The pitch delay from the previously transmitted frame $\tau(m-1)$ is also used. The decoder will utilize i, $\tau(m)$, and $\tau(m-1)$ to produce an interpolation curve between successive pitch delay values. More particularly, the receiver will compute $\Delta_{adj}(i)$ as a function of the pitch delay adjust index i as discussed above, and apply $\Delta_{adj}(i)$ to shift the endpoints of the pitch delay interpolation curve up or down according to equation 11.

Figure 3:
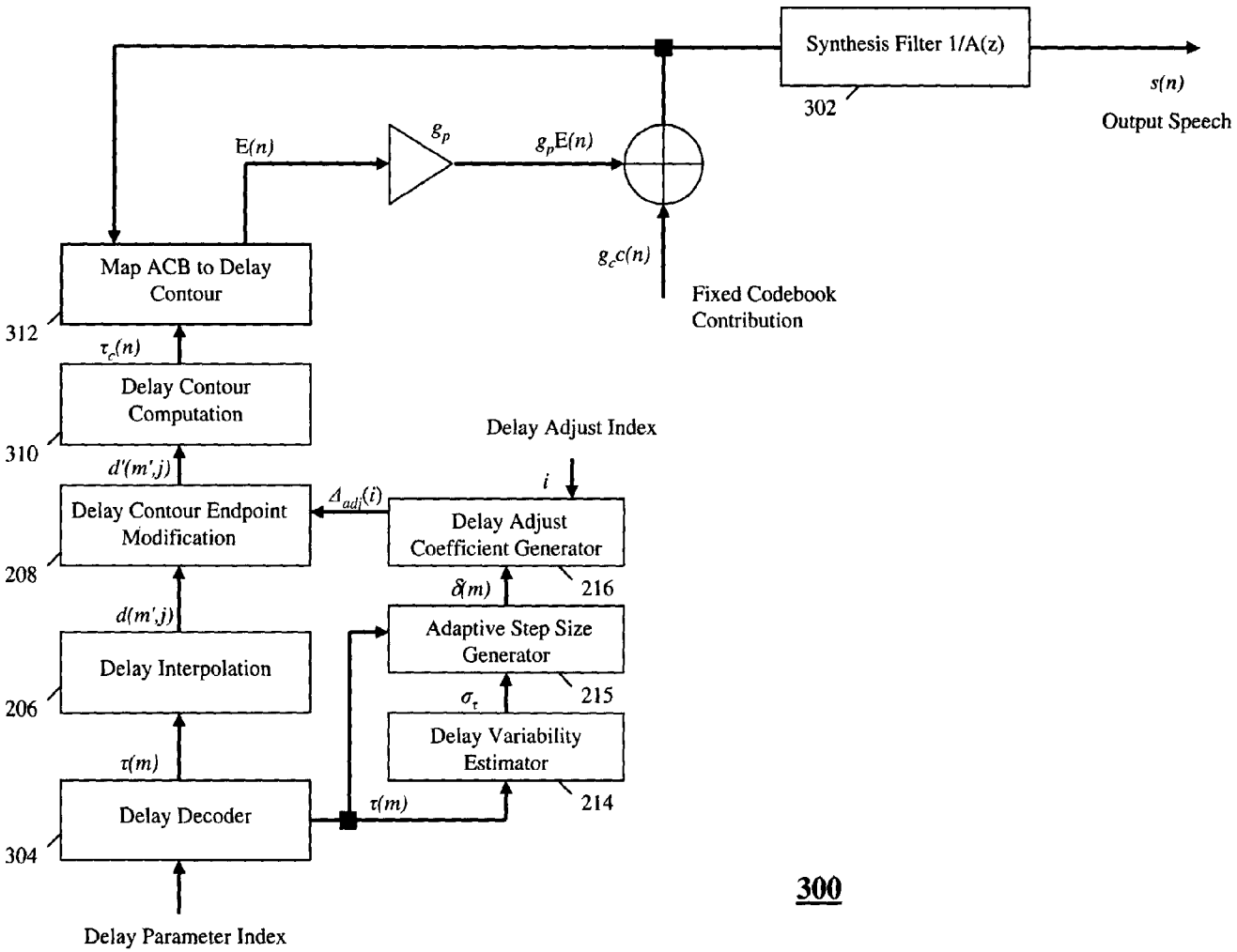
FIG. 3 is a block diagram of a speech decoder.

FIG. 3 is a block diagram of receiver 300. As shown, pitch delay parameter indexes are received by delay decoder 304 to produce $\tau(m)$. More particularly, decoder 304 receives indices or "codes" representing $\tau(m)$, and decodes them to produce $\tau(m)$ and $\tau(m-1)$. Pitch delay values are output to pitch delay variability estimator 214 where the variation in pitch delay is determined and output to adaptive step size generator 215. A value for (m) is computed by the generator 215. The adaptive step-size is output to delay adjust coefficient generator 216. A value for $\Delta_{adj}(i)$ is computed by generator 216 as a function of the pitch delay adjust index i as discussed above, and output to endpoint modification circuitry 308.

As with transmitter 200, pitch delay $\tau(m)$ is output to delay interpolation block 307 and used to produce a subframe delay interpolation endpoint matrix d(m',j) according to equation 2. Delay contour endpoint modification circuitry 308 takes the endpoint matrix and shifts the endpoints of the pitch delay interpolation curve up or down according to $d'(m',j)=d(m',j)+\Delta_{adj}(i)$. The shifted endpoints are then used by computation circuitry 310 to produce the adjusted delay contour $\tau_c(n)$, which is subsequently used to fetch samples from the ACB 312 (as in the prior art). The ACB contribution is then scaled and combined with the scaled fixed codebook contribution to produce a combined excitation signal, which is used as input to synthesis filter 302 to produce an output speech signal. The combined excitation signal is also used a feedback in order to update the ACB for the next subframe (as in the prior art).

Figure 4:
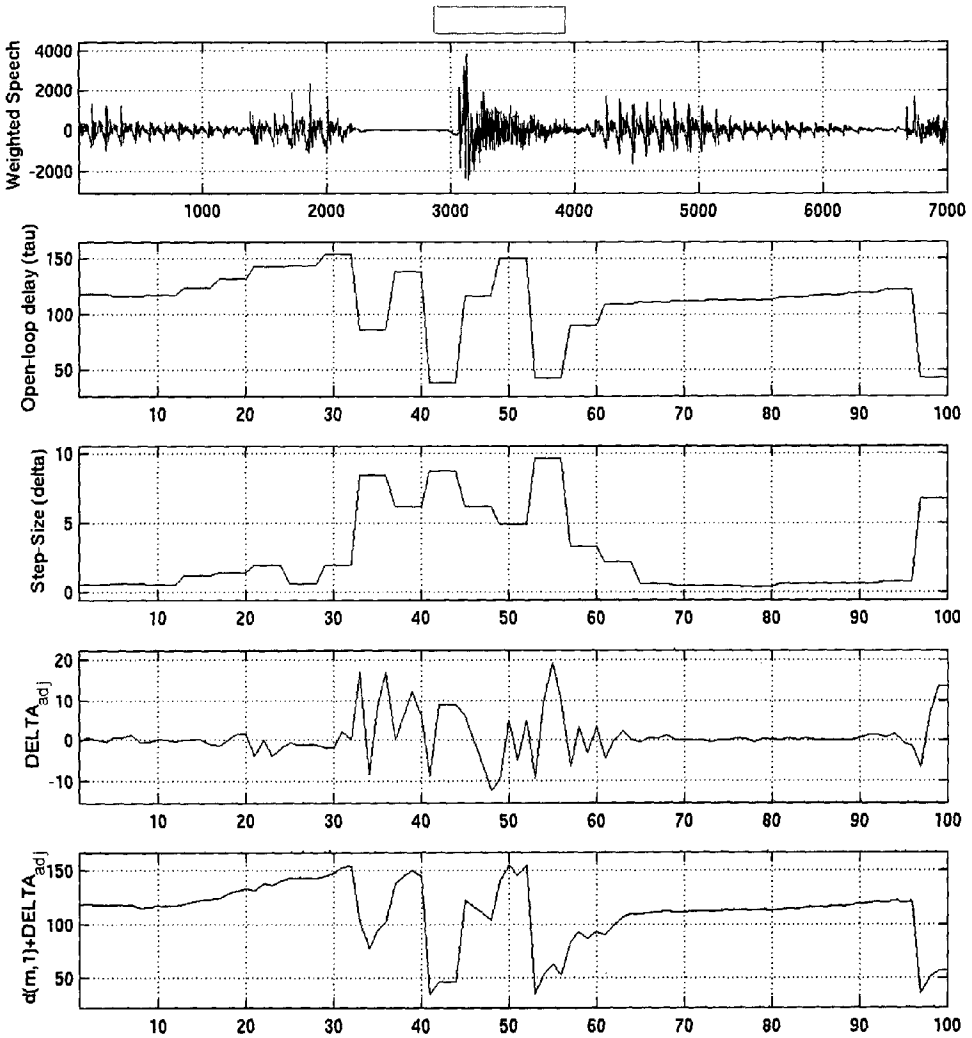
FIG. 4 illustrates a graphical representation of signals as displayed in the time domain.

FIG. 4 shows a graphical representation of the signals of the previous section as displayed in the time domain. These signals are sampled based on a wideband speech coder configuration with a sampling frequency of 14 kHz. Therefore, signal 402 (the weighted speech signal $s_w(n)$) comprises a one half second sample (7000 samples). For this example, the frame size is 280 samples, and the sub-frame size is 70. Signals 404-410 are displayed using one sample per sub-frame.

From the input signal, the open-loop pitch delay $\Delta(m)$ 404 is estimated. As can be seen, the open-loop pitch delay estimate is fairly smooth for highly periodic speech (samples 0-2000 and 4000-6500), and in contrast is fairly erratic during non-voiced speech and transitions (samples 2000-4000 and 6500-7000). In accordance with the present invention, the step-size $\delta(m)$ 406 is shown. As can be seen, the step-size is relatively small when the variability of the pitch delay estimate is small, and conversely, the step-size is relatively large when the variability of the pitch delay estimate is large. The effects of the adaptive step-size can be seen further in the optimal pitch delay adjust value $\Delta_{adj}(i)$ 408. Here, the optimal pitch delay adjustment value is based on only four candidates (2 bits per sub-frame). During the highly periodic regions, the variation is small and resolution is emphasized to allow fine tuning of the pitch delay estimate. During non-voiced and transition regions, pitch delay variation is large and subsequently a wide dynamic range is emphasized to account for a high uncertainty in the pitch delay estimate. Finally, the pitch delay adjusted endpoint d'(m',1) 410 is shown to demonstrate the final composite estimate of the pitch delay contour in accordance with the present invention. When compared to the open-loop pitch delay 404, it is easy to see the overall effect of the invention.

Figure 5:
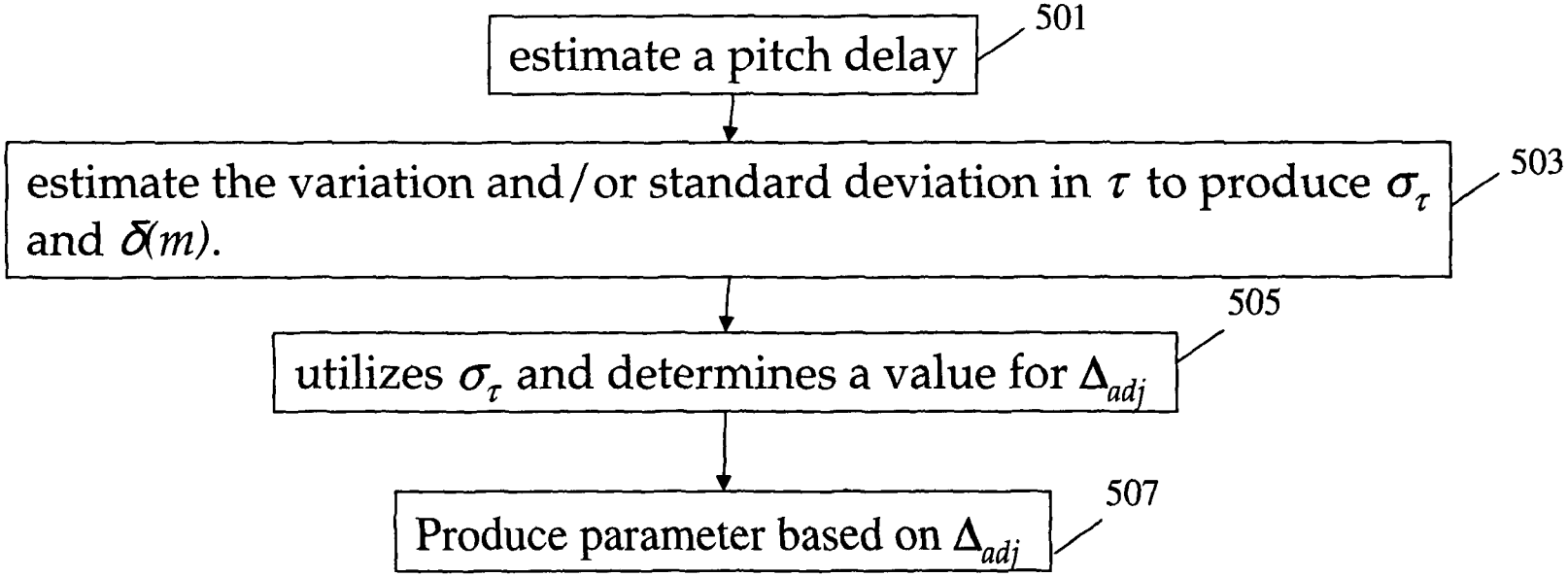
FIG. 5 is a flow chart showing operation of the encoder and decoder of FIG. 2 and FIG. 3.

FIG. 5 is a flow chart showing operation of the encoder and decoder of FIG. 2 and FIG. 3, respectively. In particular, the generation of the pitch delay adjustment value $\Delta_{adj}$ by encoder 200 and decoder 300 is described. The logic flow begins at step 501 a pitch delay is estimated by delay estimation circuitry 204, or delay decoder 304 based on an input signal. In the preferred embodiment of the present invention the input signal is preferably speech, however other audio input signals are envisioned. At step 503 pitch delay variability estimator 214 estimates the variation and/or standard deviation in pitch delay ($\tau$) based on the pitch delay estimate to produce an adaptive step-size value (m). More particularly, past values of $\tau$ are analyzed to determine $\sigma_\tau$, (m) is computed from $\sigma_\tau$ per equation (7). At step 505 pitch delay adjust coefficient generator 216 uses (m) and determines a value for an adjustment value ($\Delta_{adj}$). As discussed above, $\Delta_{adj}(i)=(i-M/2)\cdot\delta(m)$, $i\in\{0, 1, \ldots, M-1\}$, with $$\delta(m) = \alpha(\sigma_\tau)\left(\frac{\tau(m)+\tau(m-1)}{2}\right).$$

The value for $\Delta_{adj}$ is then used by modification circuitry 208 to generate a second pitch delay parameter, an in particular an encoded pitch parameter (step 507). In the preferred embodiment of the present invention the encoded pitch parameter comprise the endpoints of the pitch delay interpolation curve which are shifted up or down based on the adjustment value, and in particular according to the expression d'(m', j)=d(m', j)+$\Delta_{adj}$ (i), where i* is the optimal pitch delay adjust index corresponding to the maximum value obtained from equation 10.

While the invention has been particularly shown and described with reference to a particular embodiment, it will be understood by those skilled in the art that various changes in form and details may be made therein without departing from the spirit and scope of the invention. For example, while in the preferred embodiment of the present invention endpoints of a pitch delay interpolation curve are shifted based on the adaptive step size, one of ordinary skill in the art will recognize that any encoded pitch parameter may be generated based on the adaptive step size. More specifically, the present invention may be applied toward traditional closed loop pitch delay and pitch search methods (e.g., U.S. Pat. No. 5,253,269) by allowing the search range and/or resolution (i.e., the step size) to be based on a function of the pitch delay variability. Such methods are currently limited to predetermined resolutions based solely on absolute range of the current pitch value being searched.

Use of the present invention in prior art decoding processes is also viewed to be obvious by one skilled in the art. For example, while in the preferred embodiment of the present invention endpoints of a pitch delay interpolation curve are shifted up or down based on the adaptive step size, one of ordinary skill in the art will recognize that any pitch delay parameter may be generated based on the adaptive step size. As in the previous discussion, a speech decoder such as the GSM HR may use an adaptive step size, based on the variation in pitch delay obtained from any first pitch delay parameter, to determine a range and resolution of the delta coded lag information (i.e., a second pitch delay parameter). Therefore, the second pitch delay parameter may be based on the adaptive step size.

In addition, an alternate distortion metric may be used, such as the minimization of an accumulated shift parameter or the maximization of a normalized cross correlation parameter (as described in U.S. Pat. No. 6,113,653) to achieve pitch delay contour adjustment in accordance with the present invention. It is obvious to one skilled in the art that the present invention is independent of the distortion metric being applied, and that any method may be used without departing from the spirit and scope of the present invention.

What we claim is:

1. A method of operating a speech encoder, the method comprising the steps of:

estimating a pitch delay based on an input signal;

estimating a variation in pitch delay based on the pitch delay estimate;

determining a pitch delay adaptive step size value based on the estimated variation in pitch delay;

determining a pitch delay adjustment value based on the pitch delay adaptive step size; and generating an encoded pitch parameter based on the pitch delay adjustment value.

2. The method of claim 1 wherein the step of estimating a variation in pitch delay comprises estimating one or more of a variance of the pitch delay and a standard deviation of the pitch delay.

3. The method of claim 1 wherein the step of determining the adaptive step size comprises the step of determining the adaptive step size δ(m), where δ(m) may be expressed as:

$$\delta(m) = \alpha(\sigma_\tau)\left(\frac{\tau(m) + \tau(m-1)}{2}\right)$$

and where $\alpha(\sigma_\tau)$ is some function of the variability estimate of pitch delay, and τ(m) is a pitch delay estimate for frame number m.

4. The method of claim 3 wherein $\alpha(\sigma_\tau)=\min(A\sigma_\tau+B, \alpha_{max})$ where A and B are predetermined values, $\sigma_\tau$ represents the standard deviation in τ, and $\alpha_{max}$ is a maximum allowable value of $\alpha(\sigma_\tau)$.

5. The method of claim 1 wherein the step of generating the encoded pitch parameter based on the pitch delay adjustment value comprises the step of determining a delay adjust value $\Delta_{adj}$ where $$\Delta_{adj}(i)=(i-M/2)\cdot\delta(m), i\in\{0,1,\ldots,M-1\}$$

and where M is the number of candidate pitch delay adjustment indices, δ(m) is the adaptive step-size, and $i\in\{0, 1, \ldots, M-1\}$ is the encoded pitch parameter.

6. The method of claim 5 wherein the pitch delay adjustment value $\Delta_{adj}$ is used to shift endpoints of a pitch delay interpolation curve up or down according to the expression:

$$d'(m',j)=d(m',j)+\Delta_{adj}(i)$$

where d(m', j) is a subframe delay interpolation endpoint matrix.

7. The method of claim 1 wherein the step of generating the encoded pitch parameter based on the pitch delay adjustment value comprises the step of evaluating a distortion criteria.

8. The method of claim 7 wherein the step of evaluating the distortion criteria comprises the step of evaluating one of the set of the minimization of a mean squared error parameter, the minimization of an accumulated shift parameter, and the maximization of a normalized cross correlation parameter.

9. The method of claim 1 wherein a granularity of the pitch delay adaptive step size corresponds to a size of the variation in pitch delay.

10. A method of operating a speech decoder, the method comprising the steps of:

receiving a first pitch delay parameter;

estimating, by the speech decoder, a variation in pitch delay based on the first pitch delay parameter;

determining, by the speech decoder, a pitch delay adaptive step size based on the estimated variation in pitch delay;

determining, by the speech decoder, a pitch delay adjustment value based on the pitch delay adaptive step size; and generating, by the speech decoder, a second pitch delay parameter based on the pitch delay adjustment value.

11. The method of claim 10 wherein the step of determining the adaptive step size comprises the step of determining the adaptive step size δ(m), where δ(m) may be expressed as:

$$\delta(m) = \alpha(\sigma_\tau)\left(\frac{\tau(m) + \tau(m-1)}{2}\right)$$

where $\alpha(\sigma_\tau)$ is some function of the variability estimate of pitch delay, and τ(m) is a pitch delay estimate for frame number m.

12. The method of claim 11 wherein $\alpha(\sigma_\tau)=\min(A\sigma_\tau+B, \alpha_{max})$ where A and B are predetermined, $\sigma_\tau$ represents the standard deviation in τ, and $\alpha_{max}$ is a maximum allowable value of $\alpha(\sigma_\tau)$.

13. The method of claim 10 wherein the step of determining a pitch delay adjustment value based on the adaptive step size comprises the step of determining a pitch delay adjustment value $\Delta_{adj}$ where $$\Delta_{adj}(i)=(i-M/2)\cdot\delta(m), i\in\{0,1,\ldots,M-1\}$$

and where M is the number of candidate pitch delay adjustment indices, and δ(m) is the adaptive step-size.

14. The method of claim 13 wherein the pitch delay adjustment value $\Delta_{adj}$ is used to shift endpoints of a pitch delay interpolation curve up or down according to the expression:

$$d'(m',j)=d(m',j)+\Delta_{adj}(i)$$

where d(m', j) is a subframe delay interpolation endpoint matrix, and d'(m', j) is the second pitch delay parameter.

15. The method of claim 10 wherein the larger the variation in pitch delay then the larger the pitch delay adaptive step size value.

16. A system comprising:

an encoder comprising:

a pitch delay estimator that estimates a pitch delay based on an input signal;

a variability estimator that estimates a variation in pitch delay based on the pitch delay estimate;

a coefficient generator that determines a pitch delay adaptive step size based on the estimated variation in pitch delay;

a computation circuit that determines a pitch delay adjustment value based on the pitch delay adaptive step size; and modification circuitry that modifies a pitch parameter based on the pitch delay adjustment value.

17. The system of claim 16 wherein the modification circuitry modifies endpoints of a pitch delay interpolation curve up or down based on the pitch delay adjustment value.

18. The system of claim 16, wherein the variability estimator estimates a variation in pitch delay by estimating one or more of a variance of the pitch delay and a standard deviation of the pitch delay.

19. The system of claim 16 wherein the adaptive step size is computed as $$\delta(m)=\alpha(\sigma_\tau)\left(\frac{\tau(m)+\tau(m-1)}{2}\right)$$

and $\alpha(\sigma_\tau)$ is some function of the variability estimate of pitch delay.

20. The system of claim 16, wherein a granularity of the pitch delay adaptive step size corresponds to a size of the variation in pitch delay.

21. The system of claim 16, further comprising delay contour computation circuitry that generates a pitch delay contour based on the modified pitch parameter for coding an information signal.

* * * * *